US007371126B2

(12) United States Patent
Lu et al.

(10) Patent No.: US 7,371,126 B2
(45) Date of Patent: May 13, 2008

(54) ELECTRICAL CONNECTOR WITH POSITION MEANS

(75) Inventors: Kun Lu, Kunshan (CN); Hong-Qiang Han, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/584,933

(22) Filed: Oct. 23, 2006

(65) Prior Publication Data

US 2007/0093106 A1 Apr. 26, 2007

(30) Foreign Application Priority Data

Oct. 21, 2005 (CN) ..... 2005 2 0076646 U

(51) Int. Cl.
*H01R 24/04* (2006.01)

(52) U.S. Cl. ..... 439/669; 439/188

(58) Field of Classification Search ..... 439/668, 439/669, 188

See application file for complete search history.

(56) References Cited

U.S. PATENT DOCUMENTS

| | | | | |
|---|---|---|---|---|
| 4,392,708 | A | 7/1983 | Bailey et al. | |
| 6,524,138 | B1 * | 2/2003 | Li et al. | 439/669 |
| 6,918,799 | B2 | 7/2005 | Zhu et al. | |
| 7,033,226 | B1 * | 4/2006 | Chien et al. | 439/668 |
| 7,150,641 | B2 * | 12/2006 | Tsai | 439/188 |

* cited by examiner

*Primary Examiner*—Khiem Nguyen
(74) *Attorney, Agent, or Firm*—Wei Te Chung

(57) ABSTRACT

An electrical connector (100) for receiving a mating plug (5), comprises an insulative housing (1) having a front mating face (111), a mounting face (18), a plurality of side walls (12, 13, 14), and a receiving cavity (15) for receiving the plug and a plurality of passageways (181, 182, 183); a plurality of contacts (21, 22, 23, 24) retained in the passageways and each having a contacting arm and a connecting portion for mounting on a printed circuit board; and a position tab (3) mounted on the housing and extending into the receiving cavity for pressing the plug.

20 Claims, 6 Drawing Sheets

ELECTRICAL CONNECTOR WITH POSITION MEANS

BACKGROUND OF THE INVENTION

1. Field of the Invention

The present invention generally relates to an electrical connector and more particularly to an electrical connector having position means.

2. Description of Related Art

A conventional audio jack connector is usually used in electrical equipments such as stereo audio equipment, mobile phones and the like for contacting with a mating plug, and mounted on a printed circuit board, comprises an insulative housing defining a front mating face and a receiving cavity extending rearwardly through the insulative housing, and a plurality of contacts retained in the receiving cavity. Such connector is disclosed in U.S. Pat. No. 6,918,799, said plug has three contacting areas successively arranged along an axis direction thereof and electrically isolated from each other. As the mating plug is completely inserted into said receiving cavity, a holding portion of the plug abuts against the front mating face to prevent further insertion of the plug, thereby ensuring that said three contacting areas are electrically engaged with corresponding contacts of the connector. However, in some situations, a gap is required to be formed between the holding portion of the plug and the front mating face of the housing, in this way, the holding portion can not cooperate with the front mating face to position the plug upon full insertion of the plug, there is a likelihood that the plug would be inserted into a depth larger than expected, such that the three contacting areas of the plug are not capable of electrically contacting with corresponding contacts respectively.

It is thus desired to provide an electrical connector having a position means for controlling the insertion depth of the plug.

SUMMARY OF THE INVENTION

An object of the present invention is to provide an electrical connector having position means for controlling the insertion depth of a mating plug.

In order to achieve above-mentioned object, an electrical connector for receiving a mating plug, comprises an insulative housing having a front mating face, a mounting face, a plurality of side walls, and a receiving cavity extending through the mounting face for receiving the plug and a plurality of passageways communicating with the receiving cavity; a plurality of contacts retained in the passageways and each having a contacting arm and a connecting portion for mounting on a printed circuit board; and a position tab extending into the receiving cavity for pressing the plug.

Other objects, advantages and novel features of the present invention will become more apparent from the following detailed description of the present embodiment when taken in conjunction with the accompanying drawings.

DETAILED DESCRIPTION OF THE INVENTION

Figure 1:
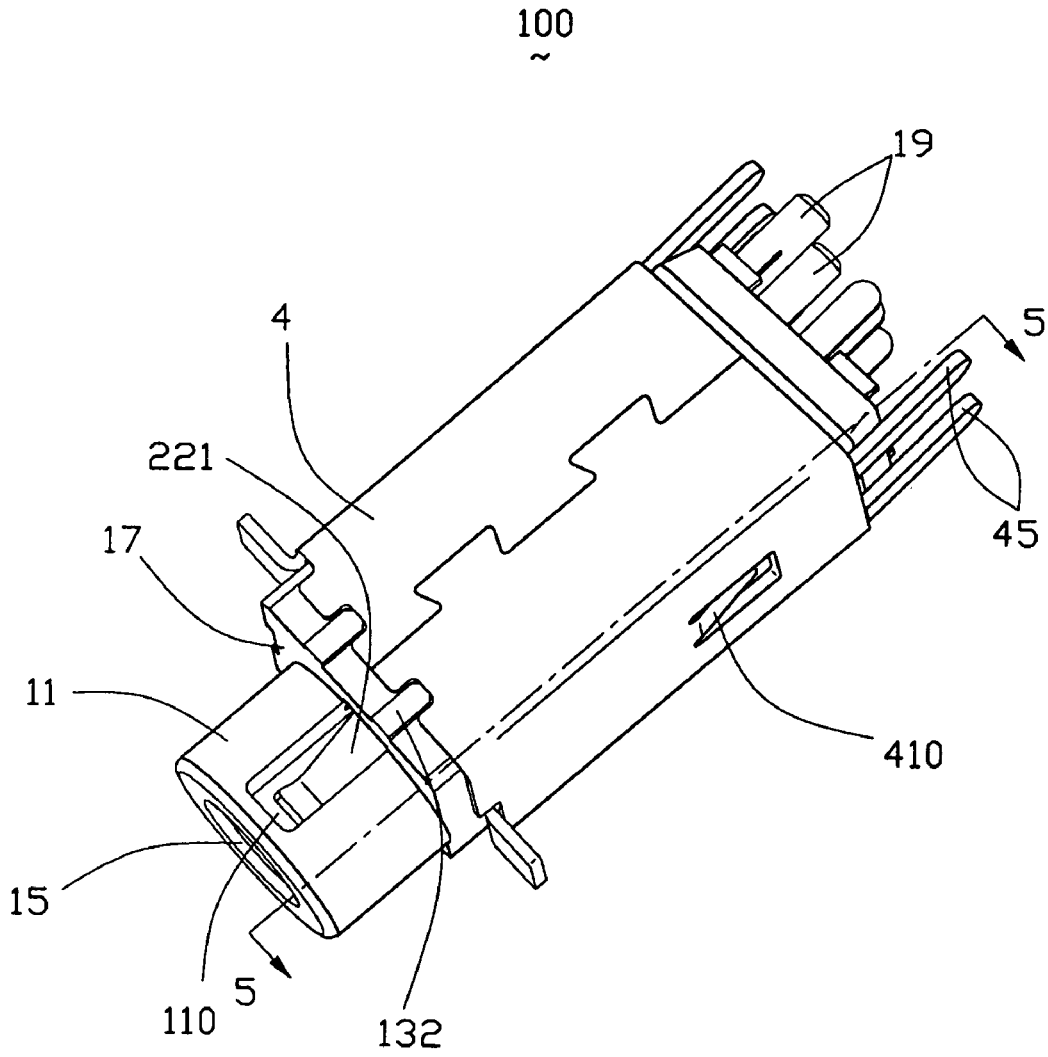
FIG. 1 is an assembled perspective view of an electrical connector according to the present invention.

Reference will now be made to the drawing figures to describe the preferred embodiment of the present invention in detail.

Figure 2:
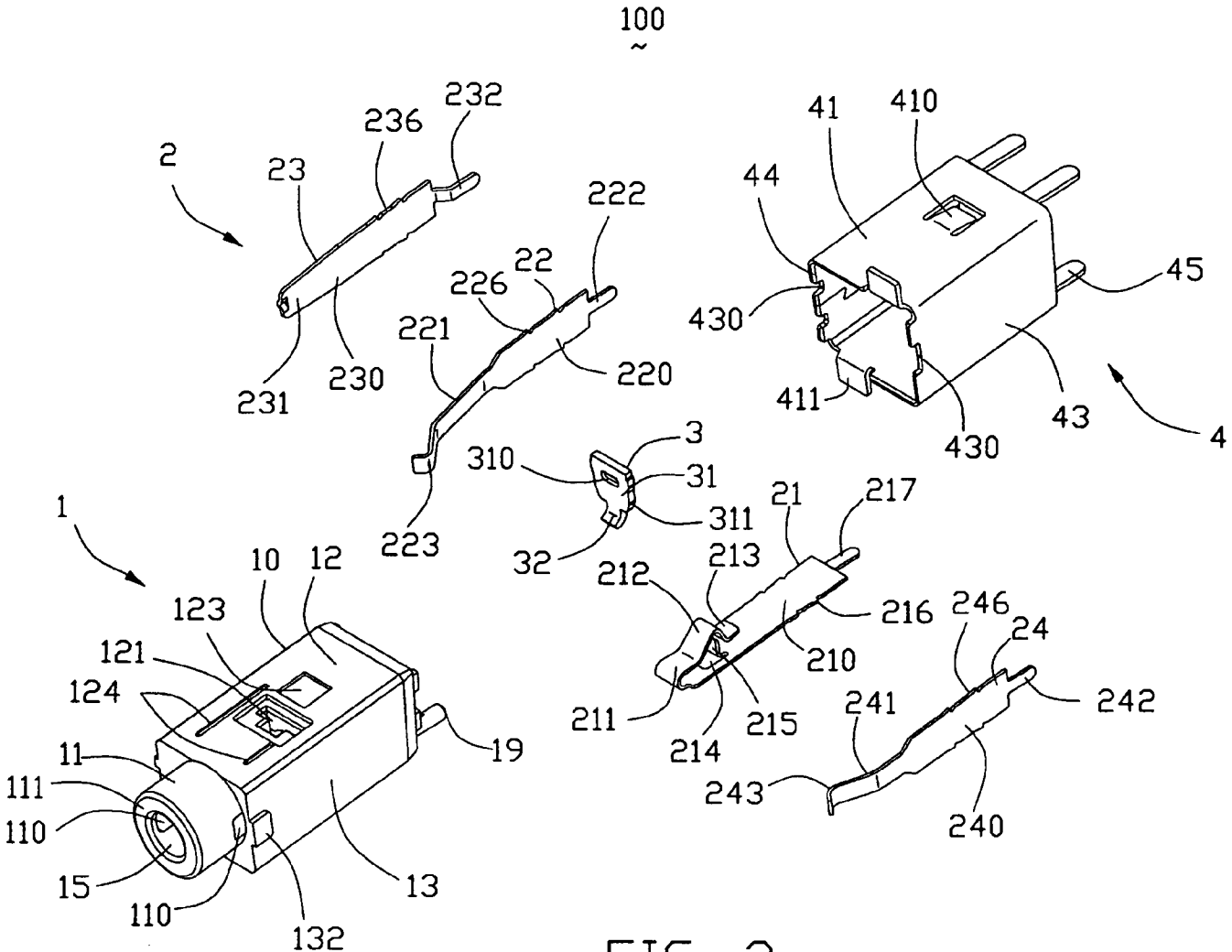
FIG. 2 is an exploded perspective view of FIG. 1.
Figure 3:
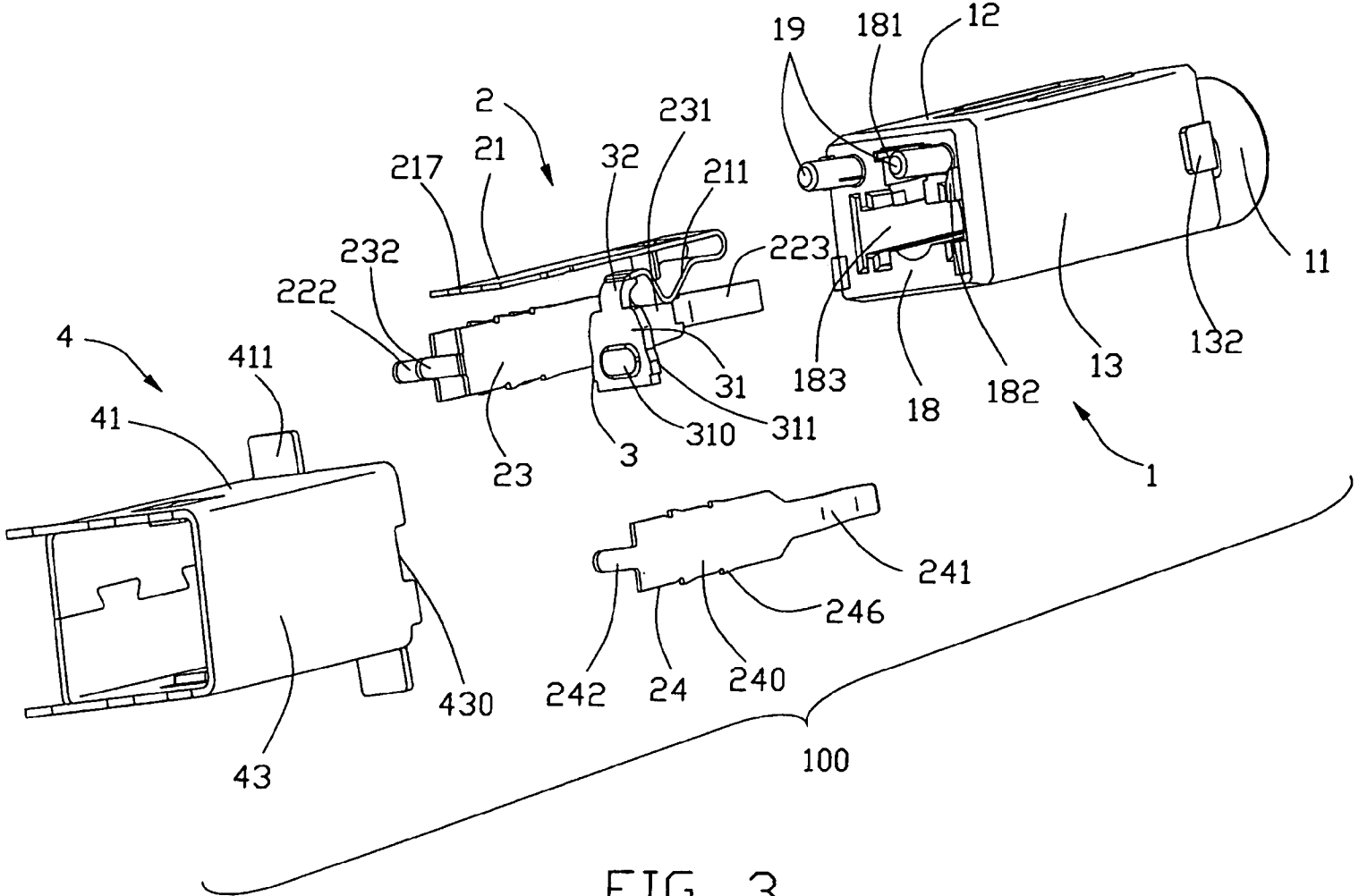
FIG. 3 is another exploded perspective view of the electrical connector.
Figure 4:
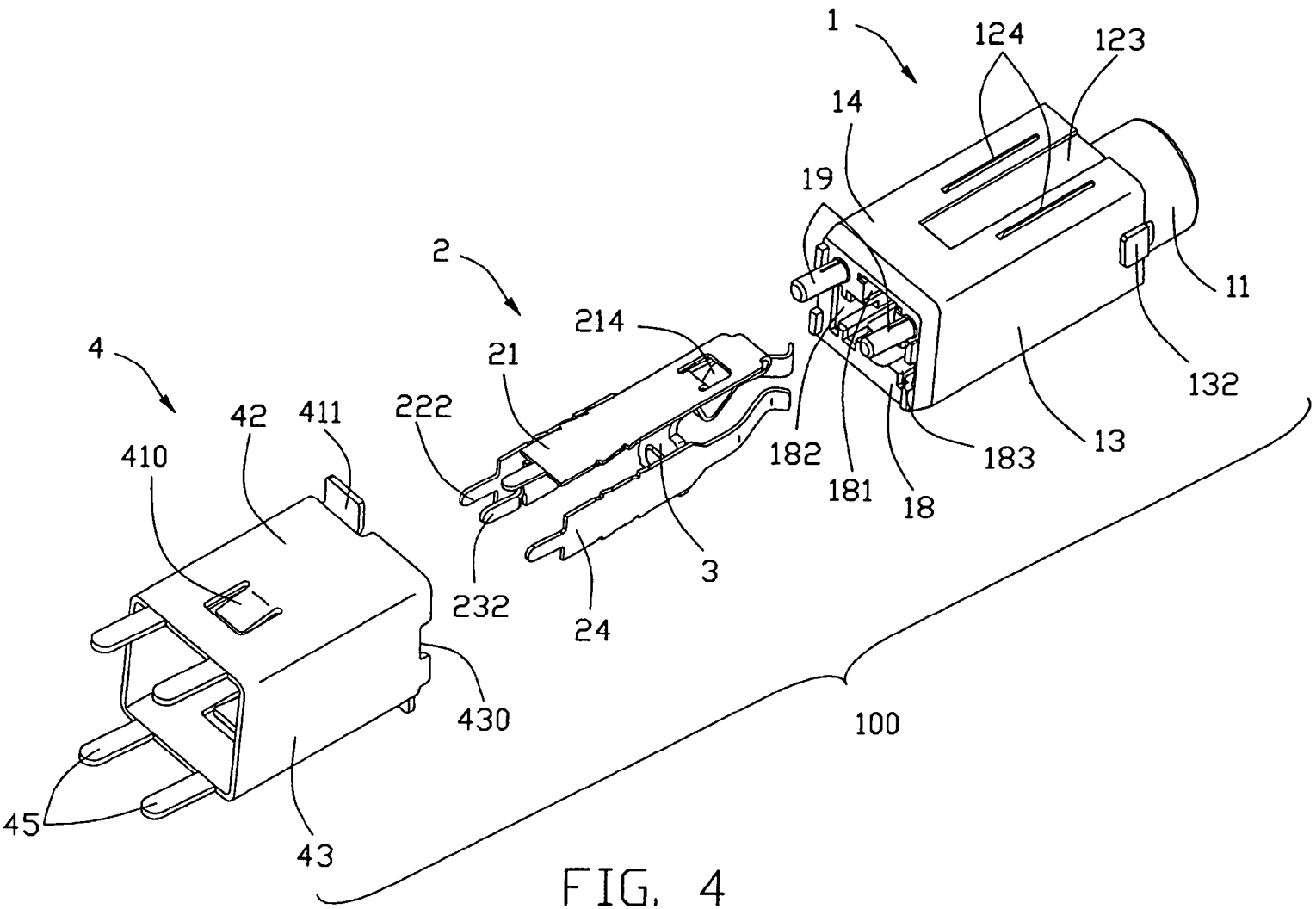
FIG. 4 is another exploded perspective view of the electrical connector similar to FIG. 3, while taken from a different aspect.
Figure 5:
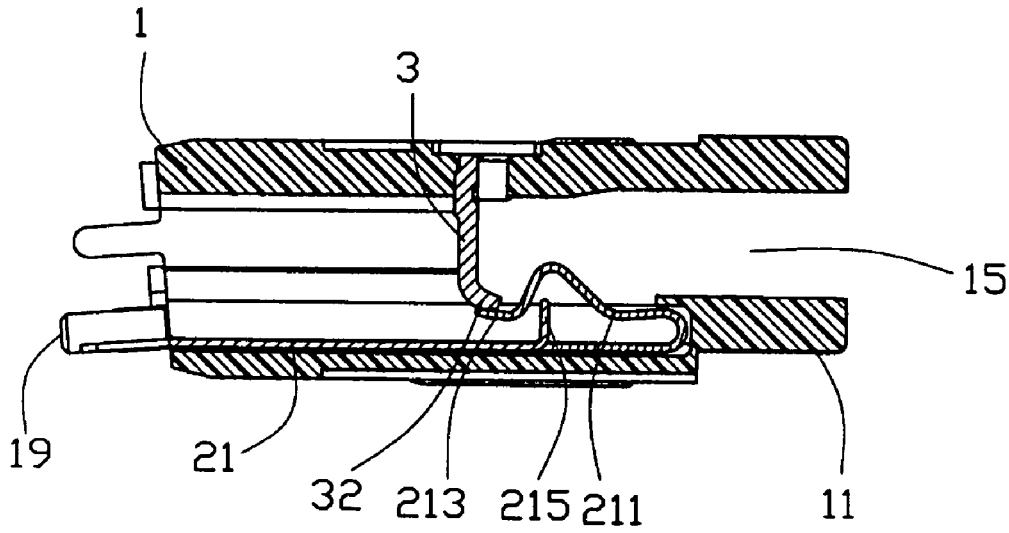
FIG. 5 is a cross-sectional view of the electrical connector taken along line 5-5 of FIG. 1.
Figure 6:
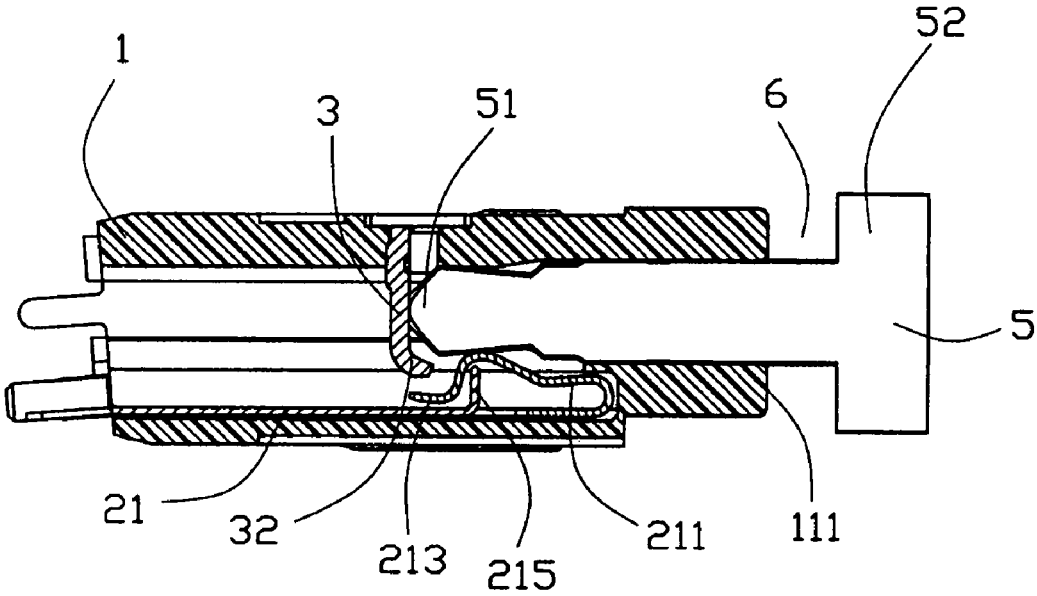
FIG. 6 is a cross-sectional view of the electrical connector with a mating plug fully inserted into the electrical connector.

Referring to FIGS. 1 and 2, an audio jack connector 100 comprises an insulative housing 1, a plurality of electrical contacts 2 and a position tab 3 retained in the housing 1 and a shell 4 substantially enclosing the housing 1.

The housing 1 has a front column portion 11 defining a front mating face 111, a body portion 10 and a receiving cavity 15 extending therethrough for receiving a stereo plug 5. Said body portion 10 has a plurality of side walls 12, 13, 14. A locking hole 123 is provided on the side wall 12 of the body portion 10 to lock with the shell 4. The side wall 12 defines a recess 121 communicating with the receiving cavity 15 and a plurality of ribs 124 extending upwardly therefrom for friction engaging with the shell 4, said recess 121 is interferentially engaged with barbs 311 formed on opposite side edges of the position tab 3, thereby attaching the position tab 3 to the housing 1. The housing 1 further has a pair of inclined posts 19 extending at a predetermined angle from a mounting face 18 of the housing 1 for mounting on a printed circuit board (not shown). A number of longitudinal passageways 181, 182, 183 communicating with the cavity 15 are formed in the housing 1 for receiving the contacts 2. A pair of projections 132 are provided on a front end of the side walls 13 of the housing 1.

The contacts 2 comprise a pair of signal contacts 21, 24 and a switch, said switch is normally closed and has a stationary contact 23 and a movable contact 22. The movable contact 22 and the signal contact 24 each includes a body 220, 240 for mounting the contact 22, 24 in the housing 1, a spring arm 221, 241 and a board connecting portion 222, 242 extending outwardly from the housing 1. Said bodies 220, 240 are disposed in a left passageway 183 and a right passageway 182 respectively and are retained therein by teeth 226, 246 formed on opposite edges of the bodies 220, 240. Said spring arm 221 is adapted to be electrically engaged with a contact arm 231 of the stationary contact 23, said spring arms 221, 241 project into the cavity 15 and each comprises a contacting portion 223, 243 for engaging a corresponding contact area of the plug 5. When the plug 5 is fully inserted into the cavity 15, the spring arm 221 is deflected outwardly by the plug 5 to move away from the contact arm 231 of the stationary contact 23, thus the switch is open. The spring arm 241 moves outwardly and contacts with the plug 5.

The stationary contact 23 has a body portion 230 defining barbs 236 on opposite edges thereof for locking with the housing 1, and a board connecting portion 232 extending beyond the housing 1 for mounting on the printed circuit board.

The signal contact 21 is received in an upper passageway 181 and includes a body portion 210 having a number of barbs 216 formed on opposite edges thereof for mounting the signal contact 21 in the housing 1, an integral spring contact arm 211 folded into cantilevered position back over the body portion 210 and an extension 213 extending downwardly from the spring contact arm 211. A mounting leg 217 projects outwardly from the other end of the body portion 210. An opening 214 is punched in the body portion 210 along a longitudinal direction thereof, a stopping tab 215 extends upwardly from a back wall of the opening 214 to be positioned beneath the contact arm 211. The contact arm 211 extends into the cavity 15, when a contacting face 212 of the contact arm 211 comes into contact with the plug 5, the contact arm 211 is deflected downwardly by the plug 5, said stopping tab 215 would abut against the contact arm 211, thus protecting the contacting arm 211 from being over biased by the plug 5 and ensuring flexibility after a long time use.

The position tab 3 is stamped and formed of sheet metal material, and has a main portion 31 defining a dimple 310 protruding forwardly therefrom for abutting against an inner wall of the recess 121 of the housing 1 in a longitudinal direction thereof, the main portion 31 projects into the cavity 15 of the housing 1 for pressing a front end 51 of the plug 5. A distal end 32 extends forwardly at a slight angle from a lower end of the main portion 31 and abuts against the extension 213 of the signal contact 21 to exert a preliminary force on the extension 213, therefore restricting upward movement of the spring contact arm 211 and ensuring flexibility of spring contact arm 211 after a long time use.

The shell 4 is stamped from a metal sheet and has a plurality of side walls 41, 42, 43, 44, a number of soldering legs 45 projects backwardly at a predetermined angle with respect to the longitudinal axis of the shell 4. The side walls 41, 42 each is formed with a latch 410 extending inwardly and backwardly to engage with the locking hole 123 of the housing 1, thus preventing the shell 4 from moving backwardly relative to the housing 1. A plurality of cutouts 430 are provided on a front edge of the side walls 43, 44 for receiving a projection 132 formed on the side walls 13 of the housing 1, thereby preventing the shell 4 from moving forwardly relative to the housing 1. A pair of ears 411 extend laterally from front edges of the side walls 41, 42 for mounting on an external panel (not shown).

In use, when the plug 5 is fully inserted into the receiving cavity 15, the front end 51 of the plug 5 abuts against the position tab 3, thus preventing further insertion of the plug 5. The movable contact 22 and the signal contacts 21, 24 come into contact with three different contacting areas of the plug 5 respectively, meanwhile, the contacting arm 221 of the movable contact 22 and the contacting arm 241 of the signal contact 24 are deflected by the plug 5 and move into through holes 110 formed on the column portion 11. A gap 6 is formed between the holding portion 52 of the plug 5 and the front mating face 111 of the housing 1. It should be noted said the position tab 3 may be formed integrally with the housing 1 and may be made of insulative materials.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving a mating plug, comprising:

an insulative housing having a front mating face, a rear mounting face, a plurality of side walls, a receiving cavity extending through the mating face and the rear mounting face for receiving the plug and a plurality of passageways, a recess extending through one of the side walls in a substantially middle portion thereof to communicate with the receiving cavity;

a plurality of contacts retained in the passageways respectively, including:

a stationary contact;

a movable contact extending into the receiving cavity for contacting with the plug and cooperating with the stationary contact to form a switch;

a pair of signal contacts each having a contacting arm extending into the receiving cavity for contacting with the plug and a connecting portion for mounting on a printed circuit board; and a position tab having a first end retained in the recess and a second end extending along a direction perpendicular to an insertion direction of the plug and extending into the receiving cavity for pressing a front end of the plug and dividing the receiving cavity into a front elongated portion for receiving the plug and a rear elongated portion.

2. The electrical connector as claimed in claim 1, wherein the position tab defines barbs formed on opposite side edges of the first end for interferentially engagement with said recess.

3. The electrical connector as claimed in claim 2, wherein a dimple is provided on the body portion for abutting against an inner wall of the recess in a longitudinal direction of the housing.

4. The electrical connector as claimed in claim 1, wherein one of the signal contacts comprises a body portion having barbs for interferentially engagement with the passageway and an opening punched in the body portion along a longitudinal direction thereof, the contacting arm is folded into cantilevered position back over the body portion, a stopping tap projects upwardly from a inner wall of the opening to be positioned beneath the contacting arm.

5. The electrical connector as claimed in claim 4, wherein the signal contact has an extension extending downwardly from the contacting arm, and the position tab has a distal end for abutting against the extension.

6. The electrical connector as claimed in claim 1, wherein the housing has a column portion with the front mating face defined thereon, the column portion having a pair of through holes communicating with the receiving cavity, the movable contact and one of the signal contacts extend into the through holes respectively upon insertion of the plug.

7. The electrical connector as claimed in claim 1, wherein the housing has a plurality of inclined posts extending at a predetermined angle with respect to a longitudinal axis of the housing, and the connecting portions of the signal contacts are parallel to the posts.

8. The electrical connector as claimed in claim 1, further comprising a shell enclosing the housing and having a plurality of legs for mounting on the printed circuit board, a number of ribs are formed on the side walls of the housing for friction engagement with the shell.

9. An electrical connector for receiving a mating plug, comprising:

an insulative housing having a front mating face, a mounting face, a plurality of side walls and a receiving cavity extending through the front mating face for receiving the plug and a plurality of passageways communicating with the receiving cavity;

a plurality of contacts inserted into the housing in a first direction along a lengthwise direction of the housing, and retained in the passageways and each having a contacting arm and a connecting portion for mounting on a printed circuit board; and a position tab extending along a second direction perpendicular to the first direction and extending into the receiving cavity for pressing a front end of the plug, and dividing the receiving cavity into a front elongated portion for receiving the plug and a rear elongated portion extending through the mounting face.

10. The electrical connector as claimed in claim 9, wherein the position tab is formed integrally with the housing, and is spaced from both the front mating face and the mounting face.

11. The electrical connector as claimed in claim 9, wherein the housing defines a rectangular body portion and a column portion with the front mating face formed thereon, said column portion has a pair of through holes communicating with the receiving cavity, two contacting arms of the contacts extend into said through holes respectively upon insertion of the mating plug.

12. The electrical connector as claimed in claim 9, wherein one of the contacts comprises a body portion having barbs for interferentially engagement with the passageway, the contacting arm is folded into cantilevered position back over the body portion with an extension extending downwardly from the contacting arm, and the position tab has a distal end extending inclinedly and downwardly for abutting against the extension.

13. The electrical connector as claimed in claim 12, wherein a stopping tap projects upwardly from the body portion and is positioned beneath the contacting arm to press the contacting arm upon full insertion of the plug.

14. The electrical connector as claimed in claim 9, further comprising a shell enclosing the housing and defining a plurality of soldering legs for mounting on the printed circuit board.

15. An electrical connector comprising:

an insulative housing defining a central cavity for receiving a pin type plug; and at least one resilient signal contact disposed in the housing with corresponding contacting section extending into the central cavity for engagement with the plug;

a positioning tab located at an inner end of the central cavity and having a first region for abutting against a front end of the plug when the plug is received in the central cavity, and a second region, adjacent to the first region, restricting movement of contacting section toward the central cavity when no plug is received in the central cavity; wherein said positioning tab is discrete from said resilient signal contact, and independently retained in the housing.

16. The connector as claimed in claim 15, wherein said signal contact further defines a stopping tab restricting movement of the contacting section away from the central cavity when the plug is received in the central cavity.

17. The connector as claimed in claim 15, wherein said second region is engageable with a free end of the contacting section when no plug is receiving in the central plug.

18. The connector as claimed in claim 15, wherein a thickness of said positioning tab is greater than that of the resilient signal contact.

19. The connector as claimed in claim 1, wherein said position tab is discrete from said contacts, and independently retained in the housing.

20. The connector as claimed in claim 9, wherein said position tab is discrete from said contacts, and independently retained in the housing.

* * * * *